US011512858B2

(12) United States Patent
Ide et al.

(10) Patent No.: US 11,512,858 B2
(45) Date of Patent: Nov. 29, 2022

(54) AIR CONDITIONING APPARATUS AND AIR CONDITIONING METHOD

(71) Applicant: SHARP KABUSHIKI KAISHA, Sakai (JP)

(72) Inventors: Tetsuya Ide, Sakai (JP); Sho Ochi, Sakai (JP); Makoto Yamada, Sakai (JP); Hiroka Hamada, Sakai (JP); Jun Sakuma, Sakai (JP); Tsuyoshi Kamada, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 121 days.

(21) Appl. No.: 16/759,978

(22) PCT Filed: Oct. 30, 2018

(86) PCT No.: PCT/JP2018/040241

§ 371 (c)(1),
(2) Date: Apr. 28, 2020

(87) PCT Pub. No.: WO2019/088061

PCT Pub. Date: May 9, 2019

(65) Prior Publication Data

US 2020/0278126 A1 Sep. 3, 2020

(30) Foreign Application Priority Data

Oct. 31, 2017 (JP) ..... JP2017-210139

(51) Int. Cl.

| | |
|---|---|
| ***F24F 11/00*** | (2018.01) |
| ***F24F 11/86*** | (2018.01) |
| ***F24F 3/14*** | (2006.01) |

(52) U.S. Cl.
CPC ..... *F24F 11/0008* (2013.01); *F24F 3/1417* (2013.01); *F24F 11/86* (2018.01)

(58) Field of Classification Search
CPC ..... F24F 3/1417; F24F 11/0008; F24F 11/72; F24F 11/80; F24F 11/86; F24F 2110/20
See application file for complete search history.

(56) References Cited

U.S. PATENT DOCUMENTS

| | | | | |
|---|---|---|---|---|
| 9,429,332 | B2 * | 8/2016 | Vandermeulen | B01D 53/263 |
| 9,874,365 | B2 * | 1/2018 | Fujita | F24F 11/0008 |
| 2009/0025408 | A1 | 1/2009 | Matsui et al. | |

FOREIGN PATENT DOCUMENTS

| | | | |
|---|---|---|---|
| CN | 101975421 | A | 2/2011 |
| CN | 201764741 | U | 3/2011 |

(Continued)

*Primary Examiner* — Larry L Furdge
*Assistant Examiner* — Chang H Park
(74) *Attorney, Agent, or Firm* — ScienBiziP, P.C.

(57) ABSTRACT

An air conditioning apparatus according to an aspect of the invention includes: an air conditioner that has a heat pump; a humidity controller of a wet desiccant type; an air transport flow path through which air discharged from the air conditioner is transported to the humidity controller; and a control unit that includes an air conditioner temperature control unit controlling a temperature of air discharged from the air conditioner and a humidity controller humidity control unit controlling a humidity of air discharged from the humidity controller. The air conditioner supplies the air, the temperature of which is controlled, to the humidity controller via the air transport flow path and the humidity controller discharges the air, the humidity of which is controlled, into a room.

5 Claims, 7 Drawing Sheets

(56) References Cited

FOREIGN PATENT DOCUMENTS

| | | | |
|---|---|---|---|
| CN | 204063414 | U | 12/2014 |
| JP | 2006-306293 | A | 11/2006 |
| JP | 4052318 | B2 | 2/2008 |
| JP | 2012-127564 | A | 7/2012 |
| JP | 2012-132657 | A | 7/2012 |

* cited by examiner

AIR CONDITIONING APPARATUS AND AIR CONDITIONING METHOD

TECHNICAL FIELD

Some aspects of the present invention relate to an air conditioning apparatus and an air conditioning method.

This application claims priority based on Japanese Patent Application No. 2017-210139 filed in Japan on Oct. 31, 2017, the content of which is incorporated herein.

BACKGROUND ART

As means of controlling a temperature or a humidity in a room, a heat pump air conditioning device has been conventionally and widely used. Hereinafter, the air conditioning device is abbreviated as an air conditioner. For example, in a case of carrying out dehumidification, dehumidification by a conventional heat pump air conditioner involves reduction in a room temperature, so that comfortability in an indoor environment is lowered and a user feels uncomfortable in some cases. Further, an air conditioner having a dehumidification mode that does not cause reduction in a room temperature is also provided, but use of the dehumidification mode causes a problem that power consumption increases. In addition, an air conditioner having a dehumidification mode that suppresses reduction in a room temperature to be small is also provided, but the room temperature may be reduced depending on a use environment.

Factors of causing the aforementioned problems are as follows.

In the dehumidification by the conventional heat pump air conditioner, air is cooled to or below a dew point in order to condense moisture in the air, so that the user may feel cold. Moreover, in a case of the dehumidification mode that does not cause reduction in the room temperature, the air whose temperature is excessively reduced due to the dehumidification is heated to the room temperature, so that power consumption increases. Further, in the dehumidification mode that suppresses reduction in the room temperature to be small, the temperature of the air is increased, for example, by means of mixing with the air at the room temperature or routing of a high-temperature heat medium pipe. However, it is difficult to always prevent reduction in the room temperature regardless of a temperature or a humidity in the ambient environment. In this manner, when the dehumidification is carried out by the conventional heat pump air conditioner, both the dehumidification modes are difficult to control the humidity and the temperature independently so that sufficient comfortability is not provided.

For example, PTL 1 described below discloses an air conditioning system that includes a humidity controller and an air conditioner and separately supplies, into the same room, air whose humidity is controlled by the humidity controller and air whose temperature is controlled by the air conditioner. PTL 1 describes that, in the air conditioning system, since a humidity control capacity of the humidity controller is adjusted to fulfill a target relative humidity at a target temperature of the air conditioner, the temperature and the humidity in the room can be immediately controlled.

CITATION LIST

Patent Literature

PTL 1: Japanese Patent No. 4052318

SUMMARY OF INVENTION

Technical Problem

Meanwhile, in the air conditioning system of PTL 1, the air is individually supplied from each of the humidity controller and the air conditioner into the room, so that there is a problem that a place where two types of air are not sufficiently mixed is generated in the room and sufficient comfortability is not provided depending on a positional relationship between the humidity controller and the air conditioner or a condition such as a wind volume or wind direction of each air.

An aspect of the invention is made to solve the aforementioned problems and an object thereof is to provide an air conditioning apparatus and an air conditioning method that provide comfortability by appropriately controlling a temperature and a humidity in a room.

Solution to Problem

In order to achieve the aforementioned object, an air conditioning apparatus of an aspect of the invention includes: an air conditioner that has a heat pump; a humidity controller of a wet desiccant type; an air transport flow path through which air discharged from the air conditioner is transported to the humidity controller; and a control unit that includes an air conditioner temperature control unit controlling a temperature of the air discharged from the air conditioner and a humidity controller humidity control unit controlling a humidity of air discharged from the humidity controller. The air conditioner supplies the air, the temperature of which is controlled, to the humidity controller via the air transport flow path and the humidity controller discharges the air, the humidity of which is controlled, into a room.

In the air conditioning apparatus of an aspect of the invention, the humidity controller may include a moisture absorption unit that causes a liquid desiccant containing a desiccant to contact the air supplied from the air conditioner and to absorb at least a part of moisture contained in the air supplied from the air conditioner, a first liquid desiccant transport flow path through which the liquid desiccant, which already absorbs the at least the part of the moisture, is transported from the moisture absorption unit, a first air discharge flow path through which the air, the at least the part of the moisture of which is removed, is discharged from the moisture absorption unit into the room, an atomizing regeneration unit that atomizes at least a part of the moisture contained in the liquid desiccant supplied from the moisture absorption unit via the first liquid desiccant transport flow path, removes the at least the part of the moisture from the liquid desiccant and regenerates the liquid desiccant, and a second liquid desiccant transport flow path through which the liquid desiccant the moisture of which is removed is transported from the atomizing regeneration unit to the moisture absorption unit.

The air conditioning apparatus of an aspect of the invention may further include a liquid desiccant heat exchange unit that performs heat exchange at least either between a part of a pipeline of the heat pump and the first liquid desiccant transport flow path or between a part of the pipeline of the heat pump and the second liquid desiccant transport flow path.

In the air conditioning apparatus of an aspect of the invention, the liquid desiccant heat exchange unit may include at least one of a first liquid desiccant heat exchange unit that performs heat exchange between an outdoor-side pipeline of the heat pump and the first liquid desiccant transport flow path during cooling in the room and a second liquid desiccant heat exchange unit that performs heat exchange between an indoor-side pipeline of the heat pump and the second liquid desiccant transport flow path during cooling in the room.

The air conditioning apparatus of an aspect of the invention may further include an air introduction flow path through which air is introduced into the atomizing regeneration unit, and an air heat exchange unit that performs heat exchange between an outdoor-side pipeline of the heat pump and the air introduction flow path during cooling in the room.

In the air conditioning apparatus of an aspect of the invention, the humidity controller may further include a concentration detection unit that detects concentration of the liquid desiccant, and the humidity controller humidity control unit may grasp a relative humidity of the air, which is to be discharged from the humidity controller into the room, based on the concentration detected by the concentration detection unit and perform humidity control based on the relative humidity.

In the air conditioning apparatus of an aspect of the invention, the air conditioner may have a dehumidification function in addition to a temperature control function, a second air discharge flow path through which air dehumidified by and discharged from the air conditioner is discharged into the room, and a flow path switch unit that changes a flow path such that, when the air discharged from the air conditioner is the dehumidified air, the dehumidified air is discharged into the room via the second air discharge flow path, and when the air discharged from the air conditioner is not the dehumidified air, the air is transported to the humidity controller via the air transport flow path may be further included, and the control unit may control the flow path switch unit in accordance with the air discharged from the air conditioner.

An air conditioning method according to an aspect of the invention uses an air conditioner, which has a heat pump, and a humidity controller of a wet desiccant type, and supplies, to the humidity controller, air whose temperature is controlled by the air conditioner and discharges, into a room, air whose humidity is controlled by the humidity controller.

Advantageous Effects of Invention

According to an aspect of the invention, an air conditioning apparatus and an air conditioning method that provide comfortability by appropriately controlling a temperature and a humidity in a room are able to be provided.

DESCRIPTION OF EMBODIMENTS

First Embodiment

A first embodiment of the invention will be described below with reference to FIGS. 1 to 6.

Figure 1:
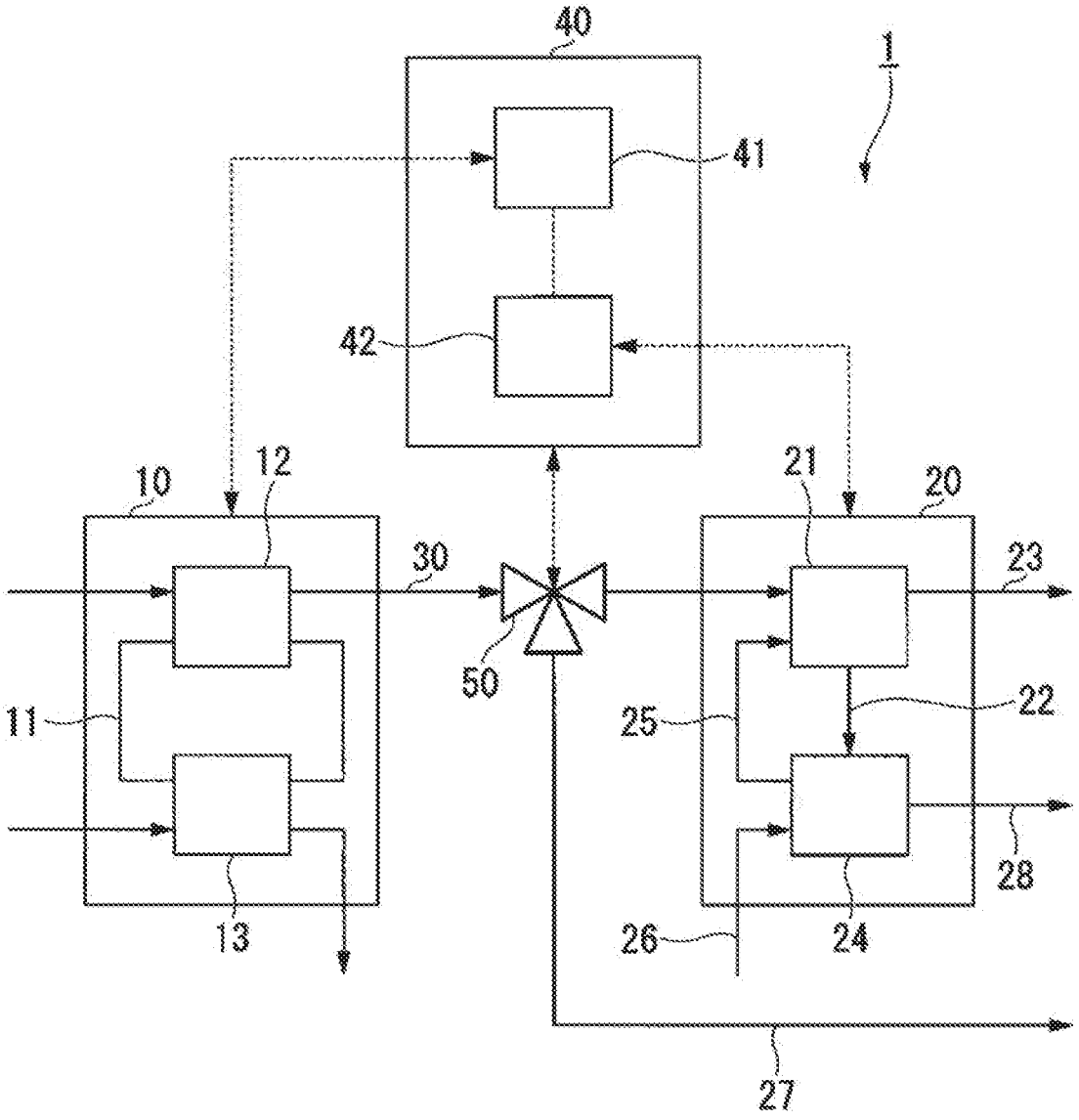
FIG. 1 is a block diagram illustrating a schematic configuration of an air conditioning apparatus of a first embodiment.

FIG. 1 is a block diagram illustrating a schematic configuration of an air conditioning apparatus of the first embodiment.

Note that, in the drawings below, components may be illustrated at different dimensional scales for the sake of ease of understanding.

As illustrated in FIG. 1, an air conditioning apparatus 1 of the present embodiment includes an air conditioner 10 having a heat pump 11, a humidity controller 20 of a wet desiccant type, an air transport flow path 30, a second air discharge flow path 27, a flow path switch unit 50, and a control unit 40.

A humidity control method of the present embodiment uses the air conditioner 10 having the heat pump 11 and the humidity controller 20 of the wet desiccant type, and includes a step of supplying air whose temperature is controlled by the air conditioner 10 to the humidity controller 20 and a step of discharging air whose humidity is controlled by the humidity controller 20 into a room.

The air conditioner 10 includes an indoor unit 12, an outdoor unit 13, and the heat pump 11. Note that, specific configurations of the indoor unit 12, the outdoor unit 13, and the heat pump 11 are the same as those of a conventional and general air conditioner and detailed description thereof will be omitted. In brief outline, the indoor unit 12 includes a fan and a heat exchange unit (both of which are not illustrated), and, when the fan rotates, the air in the room is taken in an inside of the indoor unit 12, and air whose temperature or humidity is controlled by the heat exchange unit is discharged.

The outdoor unit 13 includes a fan, a heat exchange unit, a compressor, a condenser (all of which are not illustrated), and the like, and exhaust air is discharged to the outside. The heat pump 11 includes a heat medium and a pipeline in which the heat medium circulates.

The humidity controller 20 includes a moisture absorption unit 21, an atomizing regeneration unit 24, a first liquid desiccant transport flow path 22, a second liquid desiccant transport flow path 25, a first air discharge flow path 23, an air introduction flow path 26, and a third air discharge flow path 28. The humidity controller 20 is a so-called humidity controller of a wet desiccant type that is a humidity controller of a type in which moisture in air absorbed by a liquid desiccant. A detailed configuration of the humidity controller 20 will be described later.

Through the first liquid desiccant transport flow path 22, the liquid desiccant is transported from the moisture absorption unit 21 to the atomizing regeneration unit 24. Through the second liquid desiccant transport flow path 25, the liquid desiccant is transported from the atomizing regeneration unit 24 to the moisture absorption unit 21. Through the first air discharge flow path 23, air dehumidified by the moisture absorption unit 21 is discharged. Through the air introduction flow path 26, air in the room is introduced to the atomizing regeneration unit 24. Through the third air discharge flow path 28, air humidified by the atomizing regeneration unit 24 is discharged.

The air transport flow path 30 is a flow path by which the air conditioner 10 and the humidity controller 20 are connected and through which air discharged from the air conditioner 10 is transported to the humidity controller 20. In the air conditioning apparatus 1 of the present embodiment, the air conditioner 10 supplies air, a temperature of which is controlled, to the humidity controller 20 via the air transport flow path 30, and the humidity controller 20 discharges air, a humidity of which is controlled, into the room via at least one of the first air discharge flow path 23 and the third air discharge flow path 28.

The flow path switch unit 50 composed of, for example, a three-way valve or the like is provided in a middle of the air transport flow path 30. The second air discharge flow path 27 is connected to the flow path switch unit 50. Through the second air discharge flow path 27, the air is discharged whose humidity is controlled by the air conditioner 10 during a strong dehumidification operation mode described below. The flow path switch unit 50 changes a flow path such that, when the air discharged from the air conditioner 10 is dehumidified air, the dehumidified air is discharged into the room via the second air discharge flow path 27, and when the air discharged from the air conditioner 10 is not the dehumidified air, the air is transported to the humidity controller 20 via the air transport flow path 30.

The control unit 40 includes an air conditioner temperature control unit 41 and a humidity controller humidity control unit 42. The air conditioner temperature control unit 41 controls the respective units of the air conditioner 10 to thereby control the temperature of the air discharged from the air conditioner 10. The humidity controller humidity control unit 42 controls the respective units of the humidity controller 20 to thereby control the humidity of the air discharged from the humidity controller 20.

A configuration of the humidity controller 20 will be described below.

Figure 2:
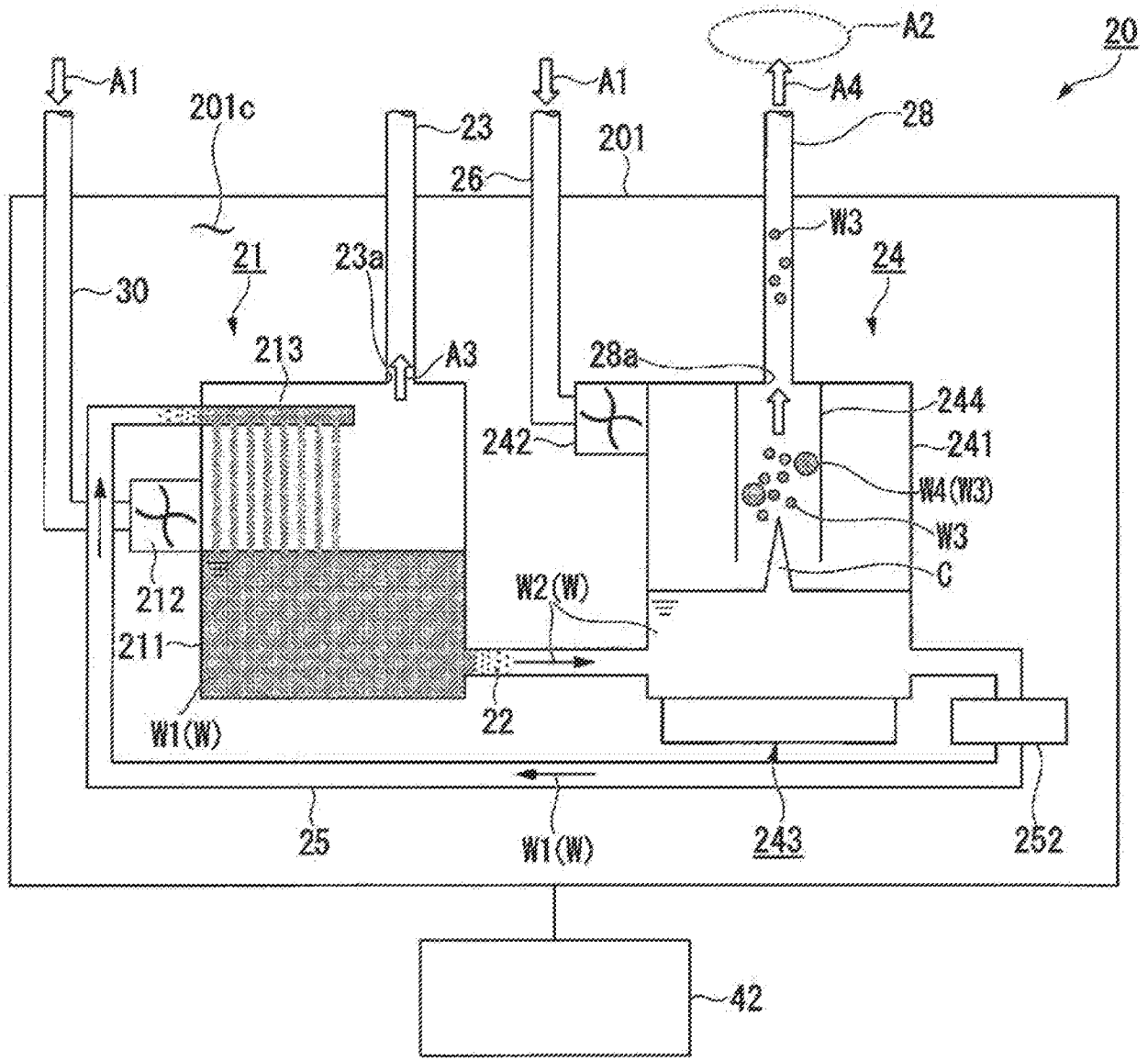
FIG. 2 illustrates a schematic configuration of a humidity controller.

FIG. 2 illustrates a schematic configuration of the humidity controller 20.

As illustrated in FIG. 2, the humidity controller 20 includes a housing 201, and the moisture absorption unit 21 and the atomizing regeneration unit 24 are accommodated in an inner space 201*c* of the housing 201.

The moisture absorption unit 21 includes a first storage tank 211, a blower 212, and a nozzle 213. The moisture absorption unit 21 causes a liquid desiccant W that contains a desiccant to contact air A1 supplied from the air conditioner 10 so that at least a part of moisture contained in the air A1 supplied from the air conditioner 10 is absorbed by the liquid desiccant W. The moisture absorption unit 21 is desired to cause as much moisture as possible to be absorbed by the liquid desiccant W, but may cause at least a part of moisture contained in the air A1 to be absorbed by the liquid desiccant. W. The liquid desiccant W is stored in an inside of the first storage tank 211. The liquid desiccant W will be described later. To the first storage tank 211, the air transport flow path 30, the first air discharge flow path 23, and the first liquid desiccant transport flow path 22 are connected. The air A1 whose temperature is controlled by the air conditioner 10 is supplied by using the blower 212 to an inner space of the first storage tank 211 via the air transport flow path 30.

The nozzle 213 is arranged in an upper part of the inner space of the first storage tank 211. A liquid desiccant W1 that is regenerated by the atomizing regeneration unit 24 described later and then returned to the moisture absorption unit 21 via the second liquid desiccant transport flow path 25 flows down from the nozzle 213 to the inner space of the first storage tank 211, and at this time, the liquid desiccant W1 and the air contact. Such a kind of form in which the liquid desiccant W1 and the air contact is typically called a "flow-down system". Note that, the form in which the liquid desiccant W1 and the air contact is not limited to the flow-down system and is able to adopt another system. For example, a so-called bubbling system that is a system in which the air made in a bubbled form is supplied into the liquid desiccant W stored in the first storage tank 211 is also able to be used.

The air A1 delivered from the air conditioner 10 forms an air flow directed from the blower 202 to a discharge port 23*a* of the first air discharge flow path 23 and contacts the liquid desiccant W that flows down from the nozzle 213. At this time, the moisture contained in the air A1 is absorbed by the liquid desiccant W and thereby removed. In the moisture absorption unit 21, air obtained by removing moisture of original air in the room is provided, so that the air is drier than air in an outer space of the humidity controller 20. In this manner, the dehumidified air is discharged into the room via the first air discharge flow path 23.

The liquid desiccant W is liquid that has a property (hygroscopicity) of absorbing moisture and is preferably liquid that has hygroscopicity, for example, at a temperature of 25° C. and a relative humidity of 50%, and under atmospheric pressure. The liquid desiccant W contains a desiccant described later. Moreover, the liquid desiccant W may contain a desiccant and a solvent. As the solvent of this kind, a solvent that dissolves the desiccant or that is mixed with the desiccant is used, and an example thereof includes water. The desiccant may be an organic material or an inorganic material.

Examples of the organic material used as the desiccant include dihydric or higher alcohol, ketone, an organic solvent having an amide group, saccharides, and a known material used as a raw material for moisturizing cosmetics etc. Among them, the dihydric or higher alcohol, the organic solvent having an amide group, the saccharides, or the known material used as the raw material for moisturizing cosmetics etc. is used as the organic material suitably used as the desiccant because of having high hydrophilicity.

Examples of the dihydric or higher alcohol include glycerin, propanediol, butanediol, pentanediol, trimethylolpropane, butanetriol, ethylene glycol, diethylene glycol, and triethylene glycol.

Examples of the organic solvent having an amide group include formamide and acetamide.

Examples of the saccharides include sucrose, pullulan, glucose, xylitol, fructose, mannitol, and sorbitol.

Examples of the known material used as the raw material for moisturizing cosmetics etc. include 2-methacryloyloxyethyl phosphoryl choline (MPC), betaine, hyaluronic acid, and collagen.

Examples of the inorganic material used as the desiccant include calcium chloride, lithium chloride, magnesium chloride, potassium chloride, sodium chloride, zinc chloride, aluminum chloride, lithium bromide, calcium bromide, potassium bromide, sodium hydroxide, and sodium pyrrolidone carboxylate.

In a case where hydrophilicity of the desiccant is high, for example, when a material of the desiccant is mixed with water, a ratio of water molecules in a vicinity of a surface (liquid surface) of the liquid desiccant W is high. The atomizing regeneration unit 24 described later causes an atomized droplet to be generated from the vicinity of the surface of the liquid desiccant W to separate moisture from the liquid desiccant W. Thus, it is preferable that the ratio of water molecules in the vicinity of the surface of the liquid desiccant W is high because the moisture is able to be efficiently separated. Moreover, it is preferable that a ratio of the desiccant in the vicinity of the surface of the liquid desiccant W is relatively low because loss of the desiccant in the atomizing regeneration unit 24 is suppressed.

In the liquid desiccant W, concentration of a desiccant contained in the liquid desiccant W1 used for processing in the moisture absorption unit 21 is not particularly limited, but is preferably 40 mass % or more. When the concentration of the desiccant is 40 mass % or more, the liquid desiccant W1 is able to efficiently absorb moisture.

Viscosity of the liquid desiccant W is preferably 25 mPa·s or less. Thereby, a liquid column of the liquid desiccant W is easily generated in the liquid surface of the liquid desiccant W in the atomizing regeneration unit 24 described later. Thus, the moisture is able to be efficiently separated from the liquid desiccant W.

The atomizing regeneration unit 24 includes a second storage tank 241, a blower 242, an ultrasonic vibrator 243, and a guide pipe 244. The atomizing regeneration unit 24 atomizes at least a part of moisture contained in a liquid desiccant W2 supplied from the moisture absorption unit 21, removes at least the part of the moisture from the liquid desiccant W2, and thereby regenerates the liquid desiccant W2. The liquid desiccant W2 to be regenerated is stored in an inside of the second storage tank 241. To the second storage tank 241, the first liquid desiccant transport flow path 22, the second liquid desiccant transport flow path 25, the air introduction flow path 26, and the third air discharge flow path 28 are connected.

The blower 242 supplies air from an outer space of the housing 201 to the inside of the second storage tank 241 via the air introduction flow path 26 and generates an air flow flowing from the inside of the second storage tank 241 to an outside of the housing 201 via the third air discharge flow path 28.

The ultrasonic vibrator 243 irradiates the liquid desiccant W2 with an ultrasonic wave to thereby cause an atomized droplet W3, which contains moisture, to be generated from the liquid desiccant W2, The ultrasonic vibrator 243 is in contact with the second storage tank 241 in a bottom part of the second storage tank 241. When the ultrasonic vibrator 243 irradiates the liquid desiccant W2 with the ultrasonic wave, by adjusting a condition under which the ultrasonic wave is generated, a liquid column C of the liquid desiccant W2 is able to be generated in a liquid surface of the liquid desiccant W2. Many atomized droplets W3 are generated from the liquid column C of the liquid desiccant W2.

Through the guide pipe 244, the atomized droplet W3 generated from the liquid desiccant W2 is guided to a discharge port 28*a* of the third air discharge flow path 28. When the humidity controller 20 is viewed from above, the guide pipe 244 is provided so as to surround the discharge port 28*a*.

Through the third air discharge flow path 28, air A4 that contains the atomized droplet W3 is discharged to the outer space of the housing 201 and removed from an inside of the humidity controller 20. This makes it possible to separate the moisture from the liquid desiccant W2. As a result, hygroscopic performance of the liquid desiccant W2 is enhanced again and the liquid desiccant W2 is able to be returned to the moisture absorption unit 21 and reused. The air A4 contains the atomized droplet W3 generated in the inside of the second storage tank 241 and is thus wetter than air A2 in the outer space of the housing 201. In this manner, the humidified air A4 is discharged into the room via the third air discharge flow path 28.

Since the discharge port 28*a* is overlapped with the ultrasonic vibrator 243 in plan view when the atomizing regeneration unit 24 is viewed from above, the liquid column C of the liquid desiccant W2 is generated below the discharge port 28*a*. Thus, the atomizing regeneration unit 24 is designed such that the guide pipe 244 surrounds the liquid column C generated in the liquid desiccant W2. When the discharge port 28*a*, the guide pipe 244, and the liquid column C have such a positional relationship, the atomized droplet W3 generated from the liquid column C of the liquid desiccant W2 is guided to the discharge port 28*a* by an air flow directed upwardly from the liquid surface of the liquid desiccant W2.

The moisture absorption unit 21 and the atomizing regeneration unit 24 are connected by the first liquid desiccant transport flow path 22 and the second liquid desiccant transport flow path 25 that form a circulation flow path of the liquid desiccant W. A pump 252 for circulating the liquid desiccant W is provided in a middle of the second liquid desiccant transport flow path 25.

Through the first liquid desiccant transport flow path 22, the liquid desiccant W whose moisture is absorbed is transported from the moisture absorption unit 21 to the atomizing regeneration unit 24. One end of the first liquid desiccant transport flow path 22 is connected to a lower part of the first storage tank 211. A part where the first liquid desiccant transport flow path 22 is connected to the first storage tank 211 is positioned below a liquid surface of the liquid desiccant W1 in the first storage tank 211. On the other hand, the other end of the first liquid desiccant transport flow path 22 is connected to a lower part of the second storage tank 241. A part where the first liquid desiccant transport flow path 22 is connected to the second storage tank 241 is positioned below the liquid surface of the liquid desiccant W2 in the second storage tank 241.

Through the second liquid desiccant transport flow path 25, the liquid desiccant W that is regenerated by the moisture being removed is transported from the atomizing regeneration unit 24 to the moisture absorption unit 21. One end of the second liquid desiccant transport flow path 25 is connected to a lower part of the second storage tank 241. A part where the second liquid desiccant transport flow path 25 is connected to the second storage tank 241 is positioned below the liquid surface of the liquid desiccant W2 in the second storage tank 241. On the other hand, the other end of the second liquid desiccant transport flow path 25 is connected to an upper part of the first storage tank 211.

A part where the second liquid desiccant transport flow path 25 is connected to the first storage tank 211 is positioned above the liquid surface of the liquid desiccant W1 in the first storage tank 211 and is connected to the nozzle 213 described above.

It has been described above that, in the humidity controller 20, dehumidified air is discharged from the moisture absorption unit 21 via the first air discharge flow path 23 and humidified air is discharged from the atomizing regeneration unit 24 via the third air discharge flow path 28. In a case where the air conditioning apparatus 1 of the present embodiment is an air conditioning apparatus having only a dehumidification function as a humidity control function, for example, a configuration in which an air discharge port of the first air discharge flow path 23 is arranged to be directed to an inside of the room and an air discharge port of the third air discharge flow path 28 is arranged to be directed to an outside of the room may be adopted. Further, in a case of an air conditioning apparatus having only a humidification function, for example, a configuration in which the air discharge port of the third air discharge flow path 28 is arranged to be directed to the inside of the room and the air discharge port of the first air discharge flow path 23 is arranged to be directed to the outside of the room may be adopted. Further, in a case of an air conditioning apparatus having both the dehumidification function and the humidification function, a configuration in which the air discharge ports of both the first air discharge flow path 23 and the third air discharge flow path 28 are arranged to be directed to the inside of the room and the control unit 40 performs control about from which of the air discharge ports air is to be discharged may be adopted.

Since the humidity controller 20 of the present embodiment includes the moisture absorption unit 21 and the atomizing regeneration unit 24 respectively having the storage tanks 211 and 241 that are separate, a degree of freedom in arrangement of both the moisture absorption unit 21 and the atomizing regeneration unit 24 is high. Accordingly, for example, the moisture absorption unit 21 and the atomizing regeneration unit 24 are able to be arranged so as to be adjacent to each other or the moisture absorption unit 21 and the atomizing regeneration unit 24 are able to be arranged so as to be separated from each other. Thus, the arrangement of the moisture absorption unit 21 and the atomizing regeneration unit 24 when the humidity controller 20 is used in combination with the air conditioner 10 is able to adopt the following three forms, for example.

Figure 3:
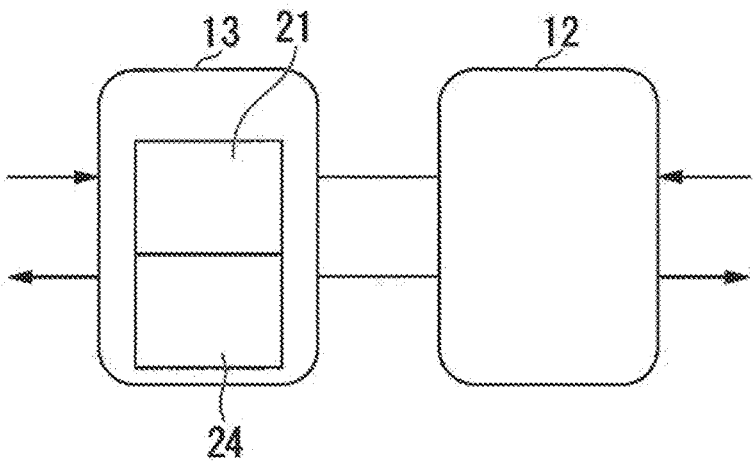
FIG. 3 illustrates an example of a form in which respective units of the humidity controller are arranged.
Figure 4:
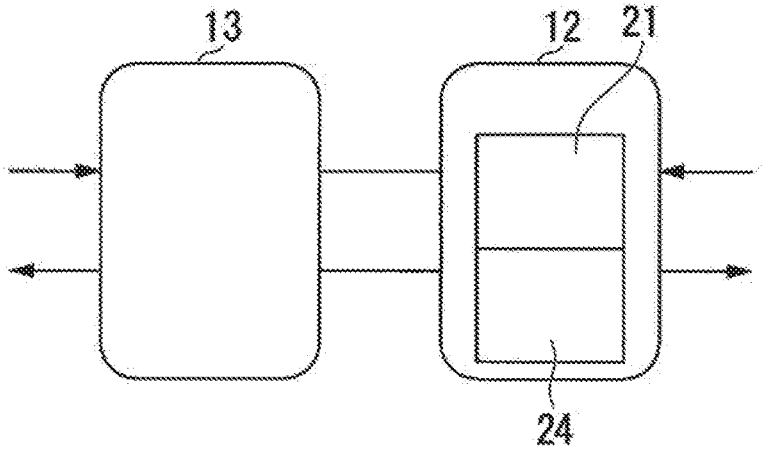
FIG. 4 illustrates another example of a form in which the respective units of the humidity controller are arranged.
Figure 5:
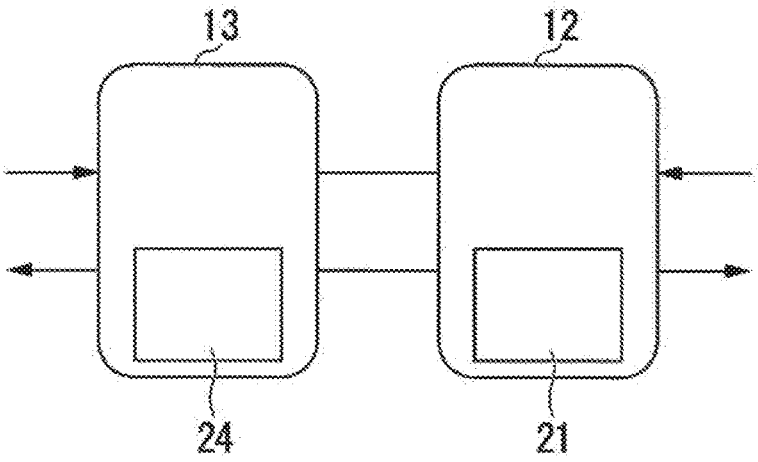
FIG. 5 illustrates still another example of a form in which the respective units of the humidity controller are arranged.

FIGS. 3 to 5 each illustrate an example of a form in which the moisture absorption unit 21 and the atomizing regeneration unit 24 are arranged in the humidity controller 20.

In a configuration example illustrated in FIG. 3, the moisture absorption unit 21 and the atomizing regeneration unit 24 are accommodated in the outdoor unit 13. In a configuration example illustrated in FIG. 4, the moisture absorption unit 21 and the atomizing regeneration unit 24 are accommodated in the indoor unit 12. In a configuration example illustrated in FIG. 5, the moisture absorption unit 21 is accommodated in the indoor unit 12 and the atomizing regeneration unit 24 is accommodated in the outdoor unit 13.

Figure 6:
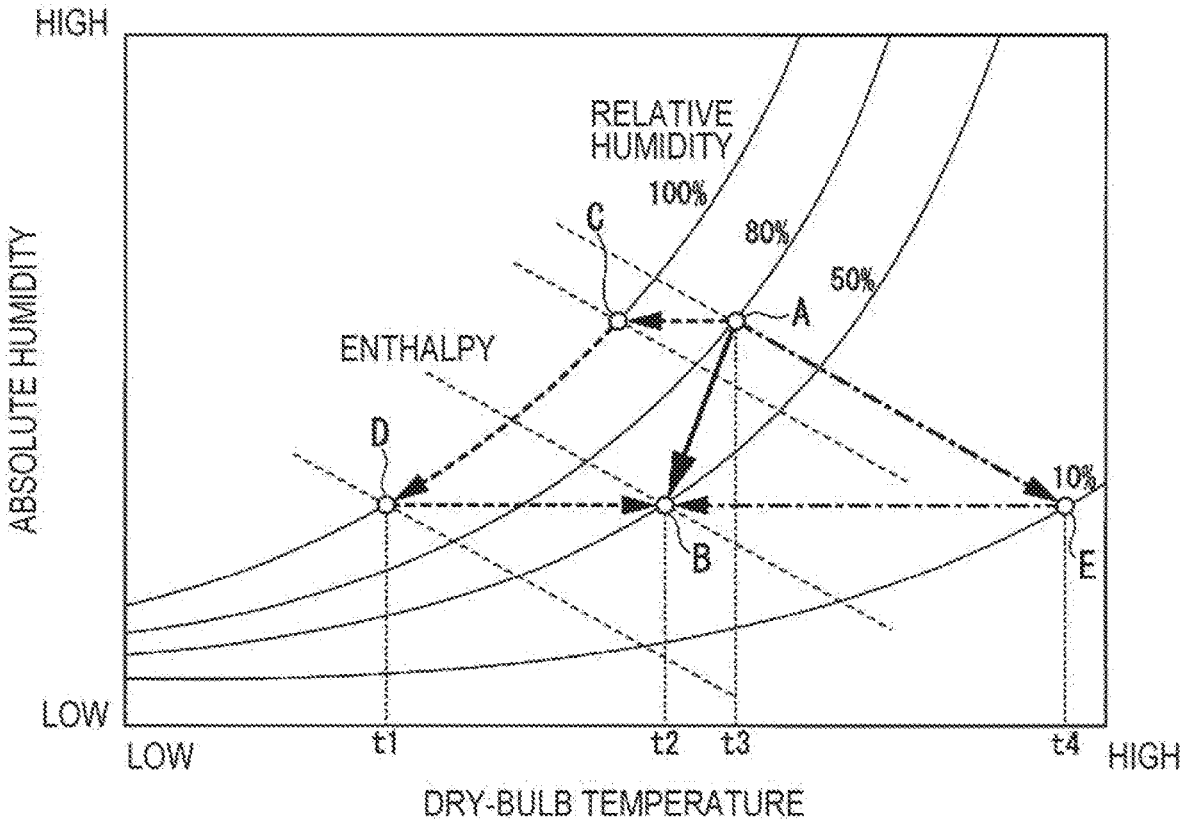
FIG. 6 is a psychrometric chart for explaining various actions of the air conditioning apparatus.

FIG. 6 is a psychrometric chart for explaining actions of the air conditioning apparatus.

In the psychrometric chart, a horizontal axis indicates a dry-bulb temperature, a vertical axis indicates an absolute humidity, and a diagonal axis indicates an enthalpy. Although an equal wet-bulb temperature line, a specific volume line, and the like are also illustrated in a typical psychrometric chart, they are not illustrated here. Moreover, a temperature of air used below corresponds to a dry-bulb temperature.

Here, for example, assumed is a case where air whose temperature is t3 (° C.) and whose relative humidity is 80% is dehumidified until the temperature and the relative humidity respectively reach t2 (° C.) and 50% as target values.

This corresponds to a change of a state of the air from a state A to a state B in FIG. 6. A large-small relationship of the following temperatures t1 to t4 is assumed as t1<t2<t3<t4.

For example, in a case where dehumidification is carried out by using a conventional heat pump air conditioner, air is cooled to or below a dew point to thereby condense and remove moisture in the air. Thus, in the case where the dehumidification described above is carried out, when the air is cooled, an absolute humidity does not change until a temperature of the air reaches the dew point, so that the state A moves to a state C along an equal absolute humidity line as illustrated in FIG. 6. Further, when the air is cooled to or below the dew point, the state C moves to a state D along the equal relative humidity line. At this time, the temperature of the air is reduced to t1. When the air in this state is heated and has the temperature increased to t2, the state D moves to the state B along the equal absolute humidity line. Thereby, the relative humidity is reduced to 50% and the state of the air reaches the state B that is a target value.

In this manner, in the dehumidification by the conventional air conditioner, the air is cooled to or below the dew point (from the state A to the state D), so that there is a problem that a user feels cold. Moreover, since the air whose temperature is reduced is heated to increase the temperature to a target temperature (from the state D to the state B), there is a problem that power consumption of the air conditioner increases.

Here, for example, a humidity controller of a dry desiccant type using a solid desiccant or the like is considered as a comparative example.

In a case where the dehumidification described above is carried out by using the humidity controller of the dry desiccant type, when air that is desired to be dehumidified contacts the desiccant or the like, moisture in the air is absorbed by the desiccant, so that air having a low relative humidity is generated. At this time, as illustrated in FIG. 6, the state A moves to a state E along an equal enthalpy line. At this time, the relative humidity is reduced to 10%, whereas a temperature of the air is increased to t4 because adsorption heat is applied to the air. When the air in this state is cooled and has the temperature reduced to t2, the state E moves to the state B along the equal absolute humidity line. Thereby, the relative humidity is 50% and the state of the air reaches the state B that is the target value.

In this manner, in the dehumidification by the dry desiccant type, there is a problem that the user feels hot, differently from the dehumidification by the air conditioner. Moreover, since the air whose temperature is increased is cooled and has the temperature reduced to the target temperature (from the state E to the state B), there is a problem that power consumption of the air conditioner increases.

On the other hand, in a case where the dehumidification described above is carried out by using the humidity controller 20 of the present embodiment, moisture in air is absorbed by the liquid desiccant, so that air having a low relative humidity is generated. Since absorption heat generated at this time is sufficiently smaller than the adsorption heat in the dry desiccant type, the temperature of the air hardly changes and the relative humidity is reduced. That is, the state A almost linearly moves to the state B as illustrated in FIG. 6.

In this manner, the humidity controller 20 of the present embodiment is able to suppress a change in the temperature of the air to a minimum, so that even when the air whose temperature has been controlled by the air conditioner 10 is supplied to the humidity controller 20, the relative humidity is able to be reduced while the temperature is kept. Thus, according to the air conditioning apparatus 1 of the present embodiment, both the temperature and the humidity in the room are appropriately controlled, so that comfortability in an indoor environment is able to be provided. Moreover, since re-heating or re-cooling does not need to be performed for the air after humidity control, an increase in power consumption caused by re-heating or re-cooling is able to be suppressed.

Moreover, the air conditioner 10 of the present embodiment has a dehumidification function in addition to a temperature control function. More specifically, the air conditioner 10 has the strong dehumidification operation mode that is called a laundry mode, a laundry drying mode, or the like and used, for example, when laundry to be dried in a room is desired to be dried quickly. That is, the air conditioner 10 has the dehumidification function in addition to the temperature control function. In such an operation mode, priority is given to quick drying of laundry by enhancing the dehumidification function over suppression of reduction in a room temperature.

When the strong dehumidification operation mode is selected in accordance with an instruction of the user, the control unit 40 controls the flow path switch unit 50 such that the air discharged from the air conditioner 10 flows not to the humidity controller 20 side but to the second air discharge flow path 27 side. The air flowing to the second air discharge flow path 27 side is directly discharged into the room without through the humidity controller 20. On the other hand, when an operation mode other than the strong dehumidification operation mode is selected, the control unit 40 controls the flow path switch unit 50 such that the air discharged from the air conditioner 10 flows to the humidity controller 20 side. Thus, according to the air conditioning apparatus 1 of the present embodiment, when an operation mode other than the strong dehumidification operation mode is set, comfortability in an indoor environment as described above is provided, and additionally, when the strong dehumidification operation mode is set, a specific function of the strong dehumidification operation mode, such as quick drying of laundry, is able to be exerted.

Second Embodiment

An air conditioning apparatus of a second embodiment will be described below with reference to FIGS. 7 to 9.

The air conditioning apparatus of the second embodiment has the same basic configuration as that of the first embodiment and is different from that of the first embodiment in that heat exchange is performed between a heat pump of an air conditioner and a liquid desiccant transport flow path of a humidity controller.

Figure 7:
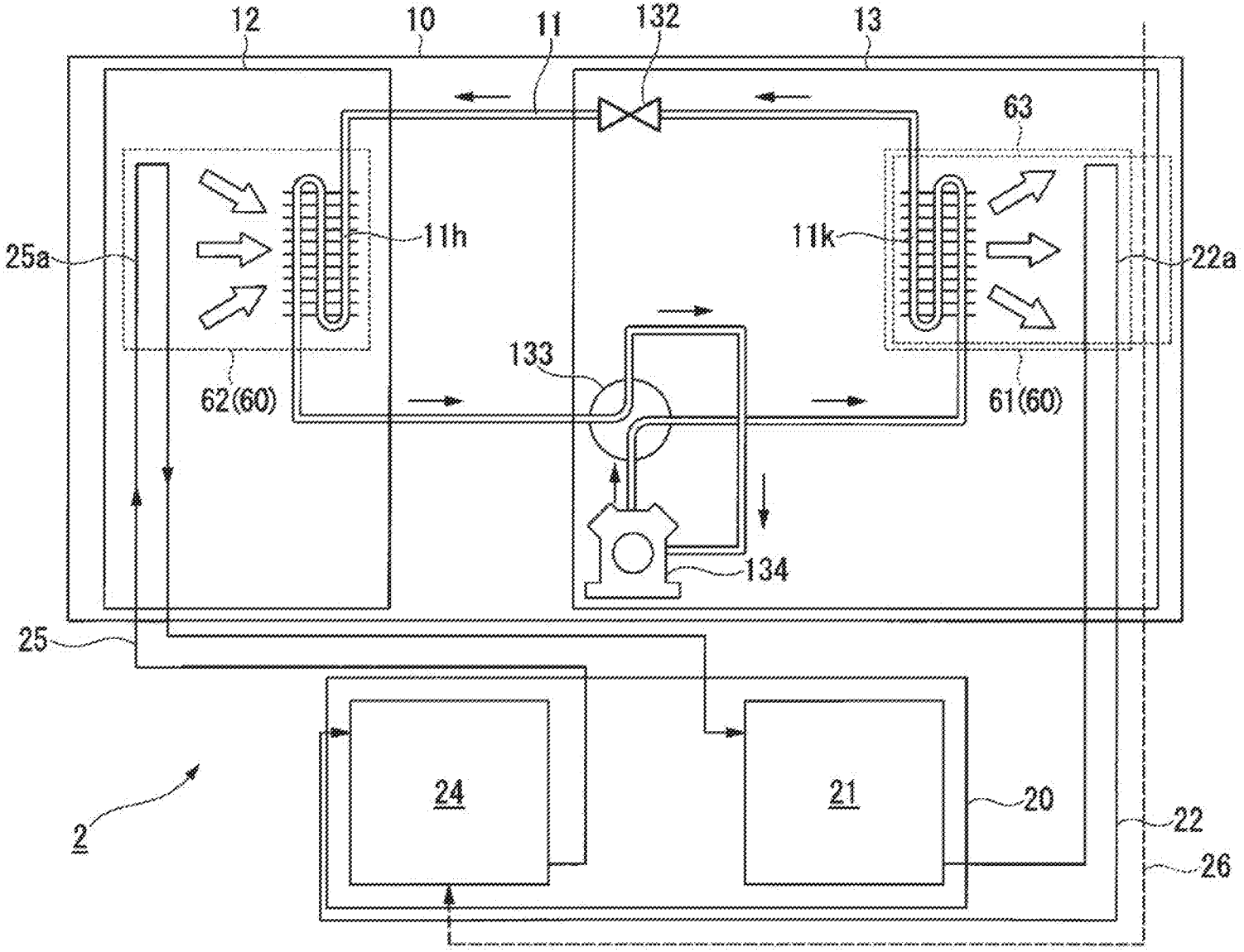
FIG. 7 is a block diagram illustrating a schematic configuration of an air conditioning apparatus of a second embodiment.

FIG. 7 is a block diagram illustrating a schematic configuration of the air conditioning apparatus of the second embodiment.

In FIG. 7, a component common to that of the drawings used in the first embodiment will be denoted by the same reference sign, and description thereof will be omitted.

Though illustration of a specific configuration related to the heat pump 11 is omitted in FIG. 1 of the embodiment, a component related to the heat pump 11 is illustrated in FIG. 7 in the present embodiment.

As illustrated in FIG. 7, the heat pump includes, in addition to the pipeline in which the heat medium circulates, an expansion valve 132, a four-way valve 133, a compressor 134, and the like. The expansion valve 132, the four-way valve 133, and the compressor 134 are accommodated in an inside of the outdoor unit 13.

The pipeline of the heat pump 11 includes an indoor-side coil 11*h* (indoor-side pipeline) accommodated in an inside of the indoor unit 12 and an outdoor-side coil 11*k* (outdoor-side pipeline) accommodated in the inside of the outdoor unit 13.

An air conditioning apparatus 2 of the present embodiment further includes a liquid desiccant heat exchange unit 60 that performs heat exchange at least either between a part of the pipeline of the heat pump 11 and the first liquid desiccant transport flow path 22 or between a part of the pipeline of the heat pump 11 and the second liquid desiccant transport flow path 25. The liquid desiccant heat exchange unit 60 includes a first liquid desiccant heat exchange unit 61 and a second liquid desiccant heat exchange unit 62. The first liquid desiccant heat exchange unit 61 performs heat exchange between the outdoor-side coil 11*k* of the heat pump 11 and a part 22*a* of the first liquid desiccant transport flow path 22 during cooling in the room. The second liquid desiccant heat exchange unit 62 performs heat exchange between the indoor-side coil 11*h* of the heat pump 11 and a part 25*a* of the second liquid desiccant transport flow path 25 during cooling in the room.

In the first liquid desiccant heat exchange unit 61, heat released from the heat medium in the heat pump 11 is absorbed by the liquid desiccant in the first liquid desiccant transport flow path 22 during cooling in the room, so that the temperature of the liquid desiccant rises as compared to that before the heat exchange. On the other hand, in the second liquid desiccant heat exchange unit 62, heat of the liquid desiccant in the second liquid desiccant transport flow path 25 is absorbed by the heat medium in the heat pump 11 during cooling in the room, so that the temperature of the liquid desiccant falls as compared to that before the heat exchange.

Note that, though an example in which the liquid desiccant heat exchange unit 60 includes both the first liquid desiccant heat exchange unit 61 and the second liquid desiccant heat exchange unit 62 is indicated in the present embodiment, the liquid desiccant heat exchange unit 60 may include at least one of the first liquid desiccant heat exchange unit 61 and the second liquid desiccant heat exchange unit 62. In particular, from a viewpoint of effectively utilizing exhaust heat, the liquid desiccant heat exchange unit 60 is desired to include the second liquid desiccant heat exchange unit 62. That is, the liquid desiccant heat exchange unit 60 is only required to perform heat exchange at least either between a part of the pipeline (heat exhaust side) of the heat pump 11 and the first liquid desiccant transport flow path 22 or between a part (heat absorption side) of the pipeline of the heat pump 11 and the second liquid desiccant transport flow path 25.

Also in the present embodiment, effects similar to those of the first embodiment that both the temperature and the humidity in the room are appropriately controlled so that comfortability in the indoor environment is provided and that an increase in power consumption associated with re-heating or re-cooling is suppressed are able to be obtained.

Further, a specific effect of the air conditioning apparatus 2 of the present embodiment will be described.

Figure 8:
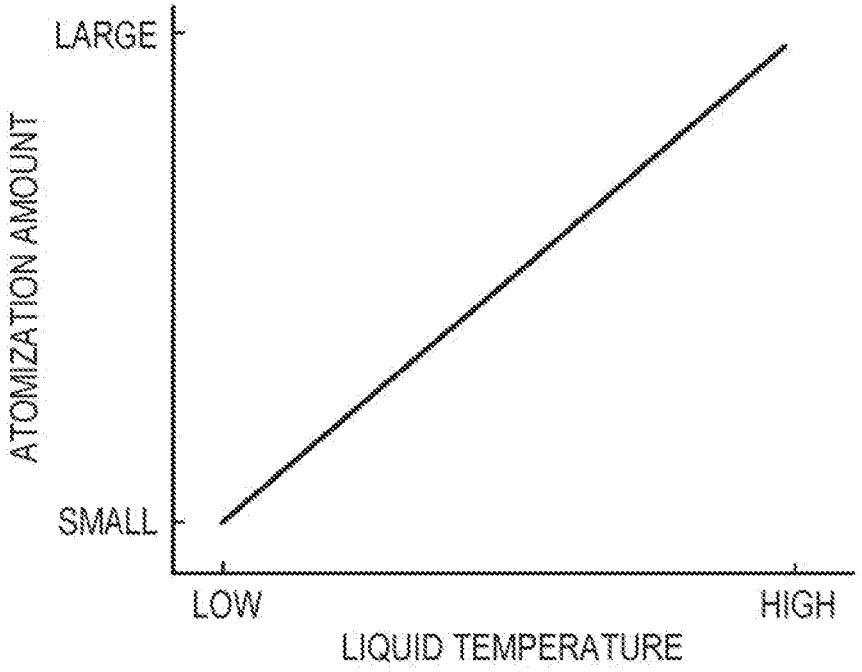
FIG. 8 illustrates a relationship between a liquid temperature and an atomization amount of a liquid desiccant in a humidity controller.

FIG. 8 illustrates a relationship between a liquid temperature and an atomization amount of the liquid desiccant in the humidity controller 20 of the present embodiment.

As illustrated in FIG. 8, the relationship between the liquid temperature and the atomization amount of the liquid desiccant indicates characteristics that the atomization amount of moisture contained in the liquid desiccant is reduced as the liquid temperature of the liquid desiccant is low, and the atomization amount of the moisture contained in the liquid desiccant is increased as the liquid temperature of the liquid desiccant is high. Thus, in order to enhance performance of regenerating the liquid desiccant by increasing the atomization amount of the moisture, the liquid temperature of the liquid desiccant supplied from the moisture absorption unit 21 to the atomizing regeneration unit 24 is preferably high. From this point of view, the air conditioning apparatus 2 of the present embodiment includes the first liquid desiccant heat exchange unit 61 and the liquid temperature of the liquid desiccant supplied to the atomizing regeneration unit 24 is able to be made high, so that the performance of regenerating the liquid desiccant is able to be enhanced.

Moreover, as illustrated in FIG. 7, the air conditioning apparatus 2 of the present embodiment may further include an air heat exchange unit 63 that performs heat exchange between the outdoor-side coil 11*k* of the heat pump 11 and the air introduction flow path 26 during cooling in the room. According to such a configuration, the temperature of the air supplied to the atomizing regeneration unit 24 is higher than that before the heat exchange, so that atomizing efficiency is enhanced and the performance of regenerating the liquid desiccant is able to be enhanced.

Figure 9:
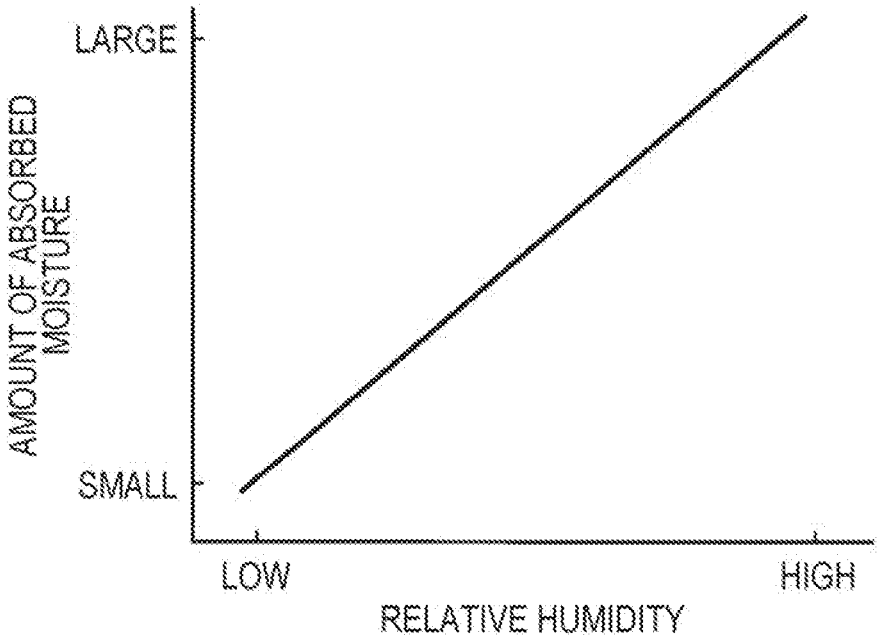
FIG. 9 illustrates a relationship between a relative humidity of air and an amount of absorbed moisture of the liquid desiccant.

FIG. 9 illustrates a relationship between a relative humidity of the air and an amount of absorbed moisture of the liquid desiccant.

As illustrated in FIG. 9, the relationship between the relative humidity and the amount of the absorbed moisture indicates characteristics that the amount of the absorbed moisture of the liquid desiccant is reduced as the relative humidity of the air is low, and the amount of the absorbed moisture of the liquid desiccant is increased as the relative humidity of the air is high. Accordingly, the relative humidity of the air needs to be made high in order to enhance dehumidification performance of the moisture absorption unit 21 by increasing the amount of the absorbed moisture of the liquid desiccant. An ambient temperature of the moisture absorption unit 21 needs to be reduced in order to make the relative humidity of the air high. From this point of view, the air conditioning apparatus 2 of the present embodiment includes the second liquid desiccant heat exchange unit 62 and reduces the ambient temperature by reducing a liquid temperature of the liquid desiccant, so that the dehumidification performance of the moisture absorption unit 21 is able to be enhanced.

Third Embodiment

An air conditioning apparatus of a third embodiment will be described below with reference to FIG. 10.

The air conditioning apparatus of the third embodiment has the same basic configuration as that of the first embodiment and is different from that of the first embodiment in a configuration of a humidity controller.

Figure 10:
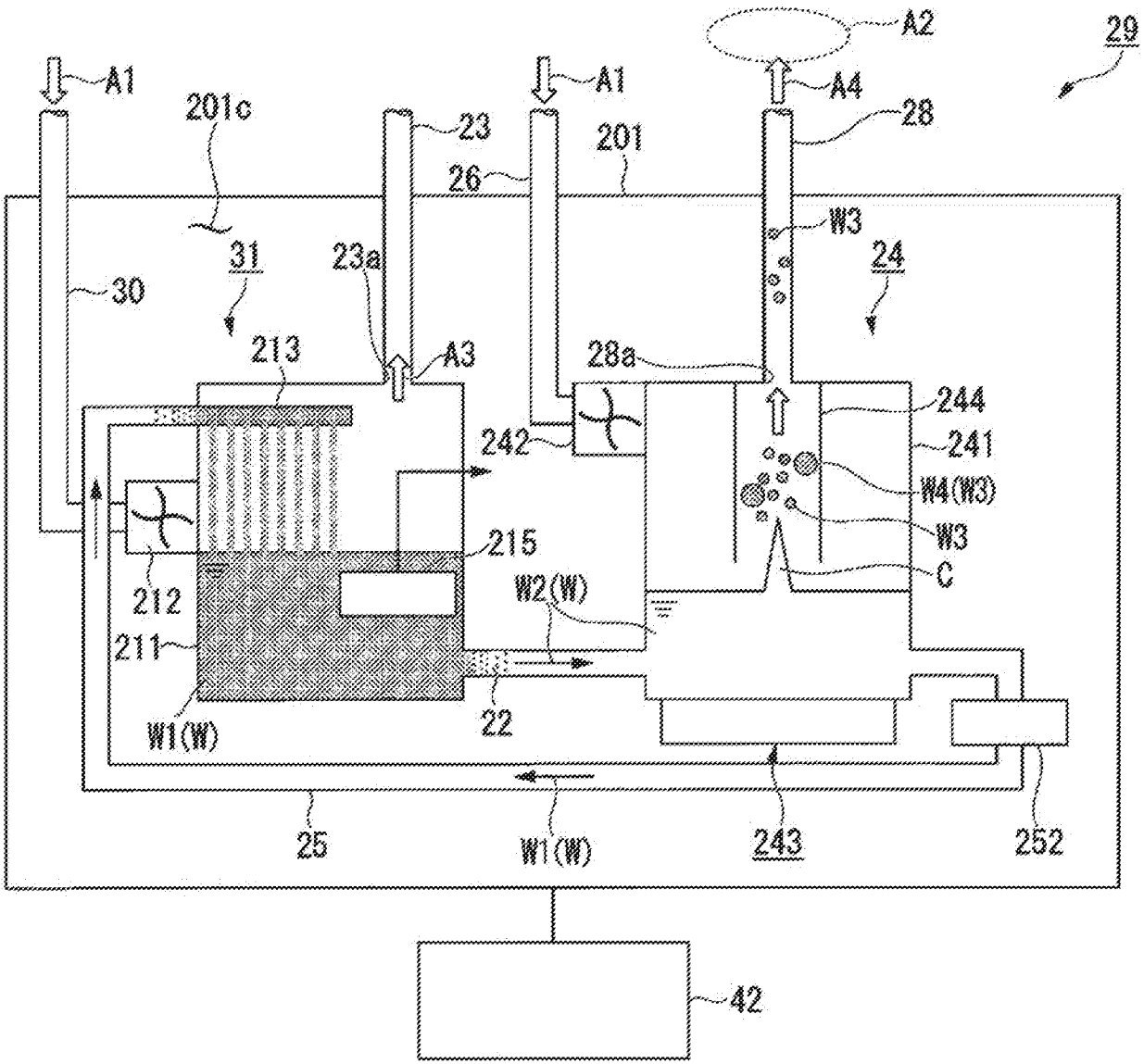
FIG. 10 illustrates a schematic configuration of a humidity controller in an air conditioning apparatus of a third embodiment.

FIG. 10 illustrates a schematic configuration of the humidity controller in the air conditioning apparatus of the third embodiment.

In FIG. 10, a component common to that of FIG. 2 used in the first embodiment will be denoted by the same reference sign, and description thereof will be omitted.

As illustrated in FIG. 10, a humidity controller 29 of the present embodiment further includes a concentration detection unit 215 that detects concentration of a liquid desiccant in a moisture absorption unit 31. As the concentration detection unit 215, for example, a concentration meter of a type that measures concentration by detecting a change in refractive index is used.

In a case of the present embodiment, the humidity controller humidity control unit 42 grasps a relative humidity of air, which is discharged into the room from the humidity controller 29 via the first air discharge flow path 23, on the basis of the concentration detected by the concentration detection unit 215 and performs humidity control on the basis of the relative humidity. The other configuration is similar to that of the first embodiment.

Also in the present embodiment, effects similar to those of the first embodiment, that both the temperature and the humidity in the room are appropriately controlled so that comfortability in the indoor environment is provided and that an increase in power consumption associated with re heating or re-cooling is suppressed are able to be obtained.

Moreover, in the case of the present embodiment, by grasping the concentration of the liquid desiccant by using the concentration detection unit 215, it is possible not only to check a regeneration state of the liquid desiccant but also to grasp the relative humidity of the air discharged from the humidity controller 29 into the room, which is able to be used for humidity control. Further, it is possible to reduce the number of humidity sensors needed for the humidity control.

Note that, a technical scope of the invention is not limited to the aforementioned embodiments and may be variously modified in a range not departing from the concept of the invention.

For example, though an example of a humidity controller including a moisture absorption unit and an atomizing regeneration unit is cited in the aforementioned embodiments, a humidity controller does not necessarily include a moisture absorption unit and an atomizing regeneration unit as long as being of a wet desiccant type.

INDUSTRIAL APPLICABILITY

An aspect of the invention is able to be utilized for an air conditioning apparatus used for air conditioning in a room.

REFERENCE SIGNS LIST

1, 2 . . . air conditioning apparatus, 10 . . . air conditioner, 11 . . . heat pump, 20, 29 . . . humidity controller, 21, 31 . . . moisture absorption unit, 22 . . . first liquid desiccant transport flow path, 23 . . . first air discharge flow path, 24 . . . atomizing regeneration unit, 25 . . . second liquid desiccant transport flow path, 26 . . . air introduction flow path, 27 . . . second air discharge flow path, 30 . . . air transport flow path, 40 . . . control unit, 41 . . . air conditioner temperature control unit, 42 . . . humidity controller humidity control unit, 50 . . . flow path switch unit, 60 . . . liquid desiccant heat exchange unit, 61 first liquid desiccant heat exchange unit, 62 . . . second liquid desiccant heat exchange unit, 63 . . . air heat exchange unit, and 215 . . . concentration detection unit.

The invention claimed is:

1. An air conditioning apparatus comprising:

an air conditioner that has a heat pump;

a humidity controller of a wet desiccant type;

an air transport flow path through which air discharged from the air conditioner is transported to the humidity controller; and an air controller that controls a temperature of the air discharged from the air conditioner and a humidity of air discharged from the humidity controller, wherein the air conditioner supplies the air, the temperature of which is controlled, to the humidity controller via the air transport flow path and the humidity controller discharges the air, the humidity of which is controlled, into a room, wherein the humidity controller includes a moisture absorption controller that causes a liquid desiccant containing a desiccant to contact the air supplied from the air conditioner and to absorb at least a part of moisture contained in the air supplied from the air conditioner, a first liquid desiccant transport flow path through which the liquid desiccant, which already absorbs the at least the part of the moisture, is transported from the moisture absorption device, a first air discharge flow path through which the air, the at least the part of the moisture of which is removed, is discharged from the moisture absorption device into the room, an atomizing regenerator that atomizes at least a part of the moisture contained in the liquid desiccant supplied from the moisture absorption controller via the first liquid desiccant transport flow path, removes the at least the part of the moisture from the liquid desiccant, and regenerates the liquid desiccant, and a second liquid desiccant transport flow path through which the liquid desiccant the at least the part of the moisture of which is removed is transported from the atomizing regenerator to the moisture absorption controller, an air introduction flow path through which air is introduced into the atomizing regenerator; and an air heat exchanger that performs heat exchange between an outdoor-side pipeline of the heat pump and the air introduction flow path during cooling in the room.

2. The air conditioning apparatus according to claim 1, wherein the humidity controller further includes concentration detector that detects concentration of the liquid desiccant, and the air controller grasps a relative humidity of the air, which is to be discharged from the humidity controller into the room, based on the concentration detected by the concentration detector and performs humidity control based on the relative humidity.

3. The air conditioning apparatus according to claim 1 further comprising a liquid desiccant heat exchanger that performs heat exchange at least either between a part of a pipeline of the heat pump and the first liquid desiccant transport flow path or between a part of the pipeline of the heat pump and the second liquid desiccant transport flow path.

4. The air conditioning apparatus according to claim 3, wherein the liquid desiccant heat exchanger includes at least one of a first liquid desiccant heat exchanger that performs heat exchange between an outdoor-side pipeline of the heat pump and the first liquid desiccant transport flow path during cooling in the room and a second liquid desiccant heat exchanger that performs heat exchange between an indoor-side pipeline of the heat pump and the second liquid desiccant transport flow path during cooling in the room.

5. An air conditioning apparatus comprising:

an air conditioner that has a heat pump;

a humidity controller of a wet desiccant type;

an air transport flow path through which air discharged from the air conditioner is transported to the humidity controller; and an air controller that controls a temperature of the air discharged from the air conditioner and a humidity of air discharged from the humidity controller, wherein the air conditioner supplies the air, the temperature of which is controlled, to the humidity controller via the air transport flow path and the humidity controller discharges the air, the humidity of which is controlled, into a room, wherein the air conditioner has a dehumidification function in addition to a temperature control function, an air discharge flow path through which air dehumidified by and discharged from the air conditioner is discharged into the room, and a flow path switch that changes a flow path such that, when the air discharged from the air conditioner is the dehumidified air, the dehumidified air is discharged into the room via the air discharge flow path, and when the air discharged from the air conditioner is not the dehumidified air, the air is transported to the humidity controller via the air transport flow path, and the air controller controls the flow path switch in accordance with the air discharged from the air conditioner.

* * * * *